United States Patent [19]

Pepiciello et al.

[11] 3,946,846

[45] Mar. 30, 1976

[54] NEWSPAPER DISPENSER

[76] Inventors: Anthony J. Pepiciello, 180 E. Beach Blvd., Dania, Fla. 33004; Charles Hrabec, 3241 SW. 44th St., Fort Lauderdale, Fla. 33312

[22] Filed: Nov. 15, 1971

[21] Appl. No.: 198,651

[52] U.S. Cl. ..... 194/1 A; 221/90

[51] Int. Cl.[2] ..... G07F 11/06

[58] Field of Search ..... 221/82, 86, 89, 90; 312/35; 194/DIG. 20, 1

[56] References Cited

UNITED STATES PATENTS

| | | | |
|---|---|---|---|
| 1,683,519 | 9/1928 | Blair | 221/90 |
| 2,006,390 | 7/1935 | Gebert | 221/90 |
| 2,361,977 | 11/1944 | Stair | 221/90 |
| 2,614,675 | 10/1952 | Booth | 194/DIG. 20 |

*Primary Examiner*—Stanley H. Tollberg
*Attorney, Agent, or Firm*—Clarence A. O'Brien; Harvey B. Jacobson

[57] ABSTRACT

A vending device for dispensing newspapers or the like, said device comprising a coin acceptor mechanism, a master dog assembly operatively connected to the coin acceptor mechanism for coacting with dispensing shelves and including a pivotally mounted master dog which permits rapid reset upon reloading of the device, and a stop pin located at the end of the path of travel of the master dog assembly to prevent full return of the coin acceptor, such that further acceptance of coins is not possible after the last newspaper has been dispensed.

10 Claims, 7 Drawing Figures

NEWSPAPER DISPENSER

The present invention is generally related to vending machines and, more particularly, to an improved coin-operated vending device for individually dispensing newspapers or the like.

In the past, a variety of coin-operated vending devices for dispensing newspapers have been provided. However, such conventional devices, for the most part, have been unreliable in operation and have permitted the acceptance of coins after the last newspaper was dispensed, thereby irritating unsuspecting customers who deposited change without knowing the machine was empty. Furthermore, most such conventional vending machine constructions have been difficult to reset and refill after the sale of each load of newspapers, thereby causing the loss of time and annoyance to the vending machine attendant.

Therefore, it is an object of the present invention to provide a novel vending device for newspapers and similar articles which may be quickly and easily reset and reloaded by a single attendant in a minimum amount of time, thereby significantly reducing the cost of the vending machine operation.

Another object of the present invention is to provide a unique coin-operated vending machine for newspapers and the like, the machine including a reciprocal coin acceptor which is prevented from returning to its coin-receiving position upon dispensing the last newspaper stored in the machine, thereby avoiding the acceptance of coins from customers unaware that the machine is empty.

It is a further object of the present invention to provide a versatile coin-operated vending device which includes a minimum number of moving parts, is durable, long-lasting, and relatively inexpensive to maintain, yet, is relatively inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
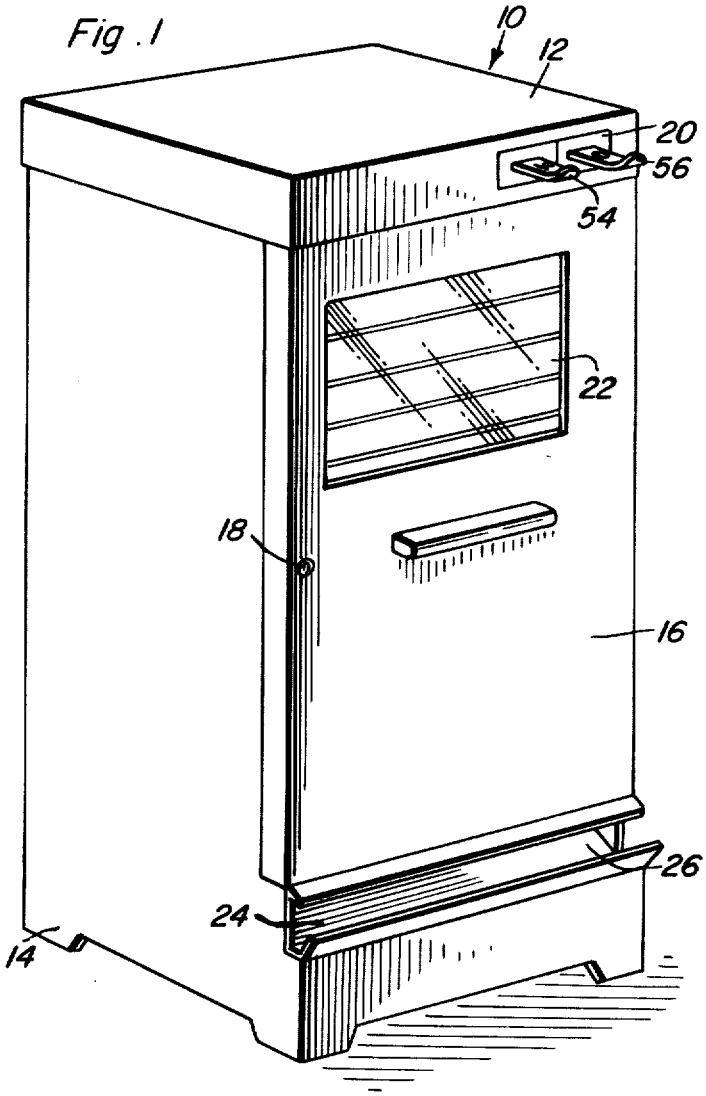
FIG. 1 is a perspective view of the coin-operated vending device of the present invention.
Figure 4:
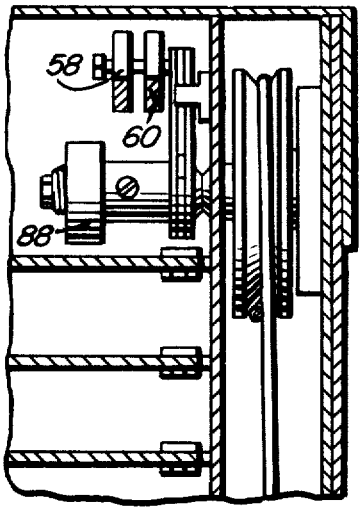
FIG. 4 is a partial sectional view taken along section 4—4 of FIG. 2.
Figure 5:
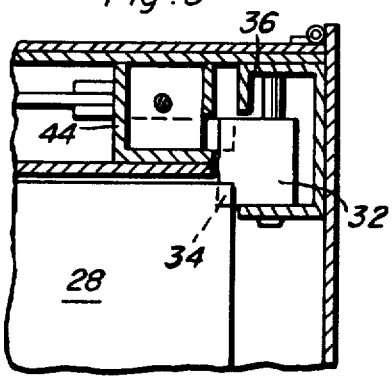
FIG. 5 is a sectional view taken along section 5—5 of FIG. 2.
Figure 3:
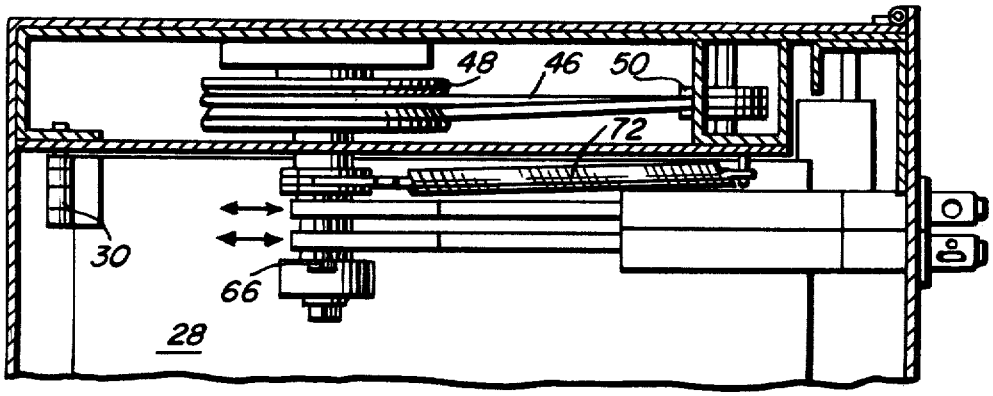
FIG. 3 is a sectional view taken along section 3—3 of FIG. 2.

Referring now, more particularly, to FIG. 1, the coin-operated vending device of the present invention is generally indicated by the numeral 10 and includes a rectangular-like housing 12, preferably, formed of sheet metal or similar light weight materials. The housing may include a plurality of support legs 14 adapted to engage the ground or other support surface to maintain the device in a stable position. Housing 12 is provided with an access door 16 which is preferably hinged to the housing along one vertical side and is provided with a key-operated lock 18 to prevent unauthorized opening of the access door or the theft of the articles stored within the housing. A coin acceptor mechanism 20 is mounted near the top of the machine to accept coins for purchase in a manner well known. The access door may be provided with a window 22 of transparent material which permits observation of the contents of the vending device and may aid the attendant or customer in determining the number of newspapers or similar articles remaining for sale. An internal chute 24 terminates at an access opening 26 at which a purchaser may remove the purchased article from the vending device. Preferably, this access opening is relatively narrow in size to prevent unauthorized entrance into the interior of the device, the minimum dimension being determined by the thickness of the articles being dispensed.

Figure 2:
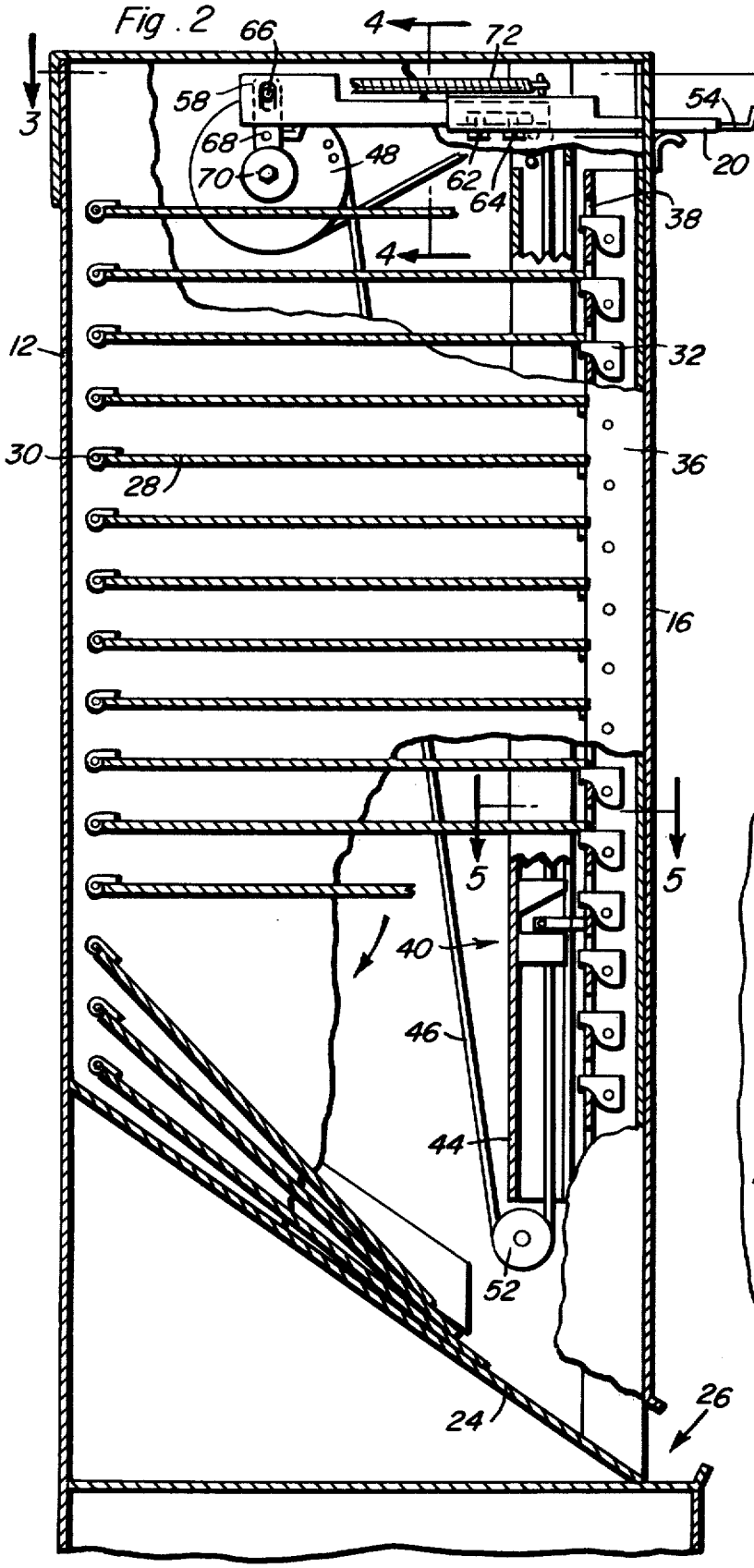
FIG. 2 is a sectional side elevation of the vending device illustrated in FIG. 1 with sections removed.

Referring to FIGS. 2–5, the internal mechanism and operation of the vending device of the present invention may be more fully understood. A substantial portion of the space within housing 12 is occupied by a plurality of shelves 28 which are vertically spaced from each other and each of which is hinged or pivotally connected to the housing along one edge as indicated at 30. As such, each shelf is movable between a substantially horizontal storing position and an inclined dispensing position, as best illustrated in FIG. 2. Each shelf is supported in the storing position by way of a pivotally mounted release dog 32 with an upper support surface 34 engaging a corresponding lower corner surface of the associated shelf. The release dogs are vertically spaced from each other and are pivotally mounted to the housing in a channel member 36 with a plurality of openings 38 in one wall through which the release dogs extend. The bottom edge of each opening 38 provides a stop means which prevents pivotal rotation of the release dogs due to the weight of the shelves they are supporting.

Release of each shelf from the storing position is achieved by way of a master dog assembly generally indicated by the numeral 40 and including a pivotally mounted master dog 42 with upper surfaces adapted to engage corresponding lower surfaces on each release dog to pivot such and release the associated shelf. The master dog assembly is mounted in a guide channel 44 for movement along a predetermined path of travel, such that the master dog sequentially engages the release dogs to release a single shelf at a time.

The master dog assembly is advanced in the upward direction by way of a cable or rope 46, or similar elongated flexible member which is operatively connected to a drive mechanism including a drive pulley, such as that indicated at 48. Idler pulleys 50 and 52 are provided at opposite ends of guide channel 44 to permit unhindered movement of the master dog assembly along its vertical path of travel.

Figure 6:
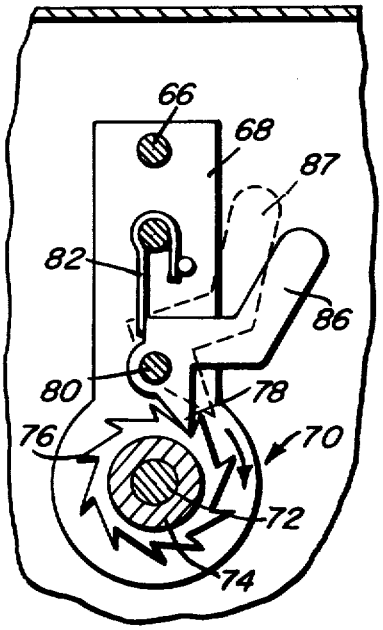
FIG. 6 is a sectional view of the manually releasable ratchet mechanism associated with the present invention.

Drive pulley 48 is rotated through a predetermined angular displacement by way of the coin acceptor mechanism 20 of the reciprocal type. The coin acceptor includes a pair of elongated coin receivers 54 and 56 which are slidably mounted for movement between innermost and outermost positions and are operatively connected to a pair of actuation members 58 and 60 by way of thumbscrews 62 and 64, respectively. Each actuation member is provided with an elongated slot which is adapted to receive an actuation pin 66 connected to or integral with drive arm 68 which effects rotation of drive pulley 48 through a ratchet mechanism indicated at 70, as best illustrated in FIG. 6. A coil tension spring 72 may be connected to the drive arm to aid in return of the coin receivers to their outermost positions.

Referring, more particularly, to FIG. 6, the drive mechanism may be seen in more detail and includes a main support shaft 73 rigidly connected to housing 12 and adapted to rotatably support a hollow drive shaft 74. Drive pulley 48 is keyed or otherwise fastened to drive shaft 74, such that they rotate in unison. The drive mechanism is further provided with a ratchet wheel 76 of a conventional type which is also keyed to drive shaft 74, such that rotation of the ratchet wheel is transmitted to drive pulley 48. A pawl 78 is pivotally connected at 80 to the drive arm 68 and is biased against the ratchet wheel teeth by way of a leaf spring 82, or similar means. As illustrated in FIG. 6 clockwise pivotal rotation of drive arm 68 is transmitted to the ratchet wheel, thereby advancing the drive pulley through an incremental angular displacement. However, counterclockwise movement of the drive arm does not advance the ratchet wheel, but merely keys the pawl for the subsequent incremental rotation. As such, it will be appreciated that the drive mechanism is advanced upon return of the coin receivers to their outermost positions, inward movement of the coin receivers merely keying the pawl with the ratchet wheel. The dimensions of the drive pulley are such that each reciprocation of the coin receivers advances the master dog assembly a distance equal to the vertical spacing between the release dogs. Therefore, a single reciprocation of the coin receivers is effective to release one of the shelves and thereby dispense a single newspaper by way of chute 24 and opening 26.

Figure 7:
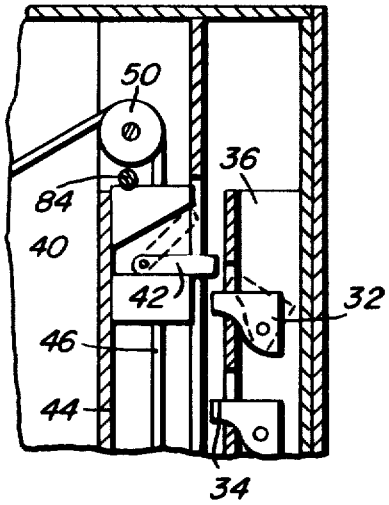
FIG. 7 is a partial elevation illustrating the master dog assembly in engagement with the stop pin after dispensing the last newspaper.

It will be appreciated that one of the versatile features of the vending device of the present invention is that it includes means which prevents further operation of the coin acceptor after the last newspaper or article has been dispensed. This is achieved by way of a stop pin 84, or similar rigid member, mounted near the upper end of guide channel 44 and adapted to engage the master dog assembly to prevent further advancement thereof. Release of the uppermost shelf is best illustrated in FIG. 7. Upon operation of the coin acceptor to dispense the next-to-last newspaper the master dog stops at a position immediately below the engagement surfaces of the uppermost release dog. Subsequent operation of the coin mechanism is such that the return pull of the coin receivers is limited to approximately one quarter the distance of normal return travel. This partial return of the coin receivers is effective to advance the drive mechanism and master dog assembly just enough to trip the uppermost release dog and dispense the last newspaper. Further travel of the master dog assembly or return of the coin receivers is inhibited by stop pin 84. This arrangement is such that the coin holes associated with each coin receiver are not exposed to accept additional coins, thereby preventing a subsequent purchaser from operating the coin mechanism, not knowing that the vending device is empty.

It will be appreciated that the shelves and master dog assembly may be quickly and conveniently reset by an attendant reloading the device. This operation is achieved by way of a reset arm 86 integral with pawl 78 and effective to disengage the pawl from the ratchet wheel, thereby freeing drive wheel 48 to return the master dog assembly to its lowermost position or to an intermediate position if partial reloading of the device is desired. By manipulating reset member 86 to a reset position, indicated at 87 in FIG. 6, a reset knob 88 coupled to the drive pulley may be rotated by the attendant, thereby moving the master dog assembly in a backward direction. Since the master dog 42 is pivotally mounted for clockwise rotation, as illustrated in FIG. 7, it is free to ride over the upper surfaces of the release dogs during the reset operation. Each of the shelves may be swung upward to its horizontal position, the associated release dog pivoting back to permit passage of the shelf and returning to its normal position to support the under corner surfaces of the shelf.

From the foregoing description, it will be appreciated that the coin-operated vending device of the present invention provides simple and convenient reset and reloading by an attendant in a minimum amount of time, thereby significantly reducing the costs of operating the device. Furthermore, the unique stop pin arrangement prevents further operation of the device after the last newspaper or article has been dispensed. It should also be noted that by utilizing thumbscrews 62 and 64, either of the coin receivers may be disconnected from the drive mechanism. This permits the disconnection of one coin receiver for less expensive daily newspapers, while both coin receivers are connected for the sale of more expensive issues, such as the Sunday News. It will be appreciated that minor changes in the number, location, or shape of the release dogs may be made as required. In addition, the release dogs may be provided with return springs, rather than a gravity drop operation as illustrated in the drawings. It will also be appreciated that the drive mechanism for advancing the master dog assembly may include a chain and sprocket for a geared type transmission mechanism, rather than the pulley and cable arrangement illustrated in the drawings. It is apparent from the foregoing description that the coin-operated vending device of the present invention is comprised of a relatively small number of moving parts, is convenient to operate and reload, is durable, long-lasting, yet, relatively inexpensive to manufacture and maintain.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. A vending device for newspapers or the like, said device comprising a housing, a plurality of spaced, pivotally mounted shelves in said housing, each movable between a storing position and a dispensing position, a plurality of release dogs each associated with one of said shelves and normally connected thereto for supporting it in said storing position, said release dogs being spaced along a predetermined path of travel and being pivotally mounted for movement from a normal shelf-supporting position toward a shelf-release position, master dog means adapted to be advanced in a first direction along said path of travel to move each release dog from its support position to its self-release position, said master dog means including a pivotally mounted master dog rotatable between an actuation position and a reset position, first stop means defined by a first stop surface associated with each of said release dogs to prevent pivotal rotation of said release dogs in one direction due to the weight of the supported shelves but permit pivotal rotation in the opposite direction by said master dog as it is advanced along said path of travel in said first direction, said master dog means including second stop means defined by a second stop surface to prevent pivotal movement of said master dog when actuating said release dogs by advancement of said master dog means in said first direction of travel and permit pivotal rotation of said master dog when said master dog means is moved backward in a direction opposite said first direction of travel, actuation means for normally selectively advancing said master dog means a predetermined incremental distance in said first direction along said path of travel to release a shelf to its dispensing position, and reset means associated with said actuation means for selectively returning said master dog means in said second direction along said path of travel, each of said release dogs including a release surface which lies directly in said path of travel of an actuation surface associated with said master dog and is engaged thereby to effect release of the associated shelf, said release surface being on the lower side of said release dog, said actuation surface being on the upper side of said master dog, each of said release dogs being provided with first reset surfaces on its upper side, said master dog being provided with second reset surfaces on its lower side, said first and second reset surfaces wipingly engaging each other upon reset movement of said master dog means in said second direction and effecting pivotal rotation of said master dog toward its reset position.

2. The structure set forth in claim 1 wherein said actuation means includes drive means with a flexible member connected to said master dog means to impart movement thereto along said path of travel, and reciprocally operated coin acceptor means operatively connected to said drive means for advancement thereof upon manual actuation of the coin acceptor means.

3. The structure set forth in claim 2 wherein said drive means is connected to said coin acceptor means by way of ratchet means for moving said drive means when said coin acceptor means is moved in one direction only.

4. The structure set forth in claim 3 wherein said reset means includes disengagement means associated with said ratchet means for disengaging said coin acceptor means from said drive means to permit return of said master dog means in said second direction of travel.

5. A coin-operated vending device comprising a housing, a plurality of spaced shelves mounted in said housing, each being movable between a storing position and a dispensing position, master dog means mounted in said housing and movable between first and second locations along a predetermined path of travel to sequentially release said shelves to their dispensing positions, drive means for advancing said master dog means from said first position to said second position, coin acceptor means for accepting coins and advancing said drive means and said master dog means in increments along said path of travel to release a shelf for each increment of movement, and means mounted in said housing at said second location for stopping travel of said master dog means along said path beyond said second location to disenable said drive means and said coin acceptor means when said master dog means reaches said second position whereby coins may not be accepted by said coin acceptor means.

6. The structure set forth in claim 5 wherein said shelves are vertically spaced, said master dog means being prevented from traveling further by said stop means subsequent to release of the uppermost of said shelves.

7. The structure set forth in claim 6 wherein said stop means is in said path of travel of said master dog means and engages said master dog means at said second location.

8. The structure set forth in claim 5 wherein said coin acceptor means includes a coin receiver reciprocally mounted to said housing for inward and outward movement relative thereto and operatively connected to said drive means for movement thereof upon outward movement of said coin receiver, said stop means being effective to prevent full return of said coin receiver when said master dog means reaches said second position.

9. The structure set forth in claim 8 wherein said shelves are vertically spaced, said master dog means being prevented from traveling further by said stop means subsequent release of the uppermost of said shelves.

10. The structure set forth in claim 9 wherein said stop means is positioned in said path of travel of said master dog means and engages said master dog means at said second location.

* * * * *